US010177458B2

(12) United States Patent
Takahashi

(10) Patent No.: US 10,177,458 B2
(45) Date of Patent: Jan. 8, 2019

(54) RADIO SYSTEM

(71) Applicant: NEC Corporation, Tokyo (JP)

(72) Inventor: Yoshihide Takahashi, Tokyo (JP)

(73) Assignee: NEC Corporation, Tokyo (JP)

( * ) Notice: Subject to any disclaimer, the term of this patent is extended or adjusted under 35 U.S.C. 154(b) by 75 days.

(21) Appl. No.: 15/303,854

(22) PCT Filed: Mar. 13, 2015

(86) PCT No.: PCT/JP2015/057518
§ 371 (c)(1),
(2) Date: Oct. 13, 2016

(87) PCT Pub. No.: WO2015/163033
PCT Pub. Date: Oct. 29, 2015

(65) Prior Publication Data

US 2017/0040708 A1 Feb. 9, 2017

(30) Foreign Application Priority Data

Apr. 24, 2014 (JP) ..... 2014-089939

(51) Int. Cl.

| | |
|---|---|
| ***H01Q 15/24*** | (2006.01) |
| ***H01P 1/165*** | (2006.01) |
| ***H01Q 1/20*** | (2006.01) |
| ***H01Q 1/24*** | (2006.01) |
| ***H01Q 3/06*** | (2006.01) |
| ***H01P 5/04*** | (2006.01) |

(52) U.S. Cl.
CPC ..... *H01Q 15/246* (2013.01); *H01P 1/165* (2013.01); *H01P 5/04* (2013.01); *H01Q 1/20* (2013.01); *H01Q 1/246* (2013.01); *H01Q 3/06* (2013.01)

(58) Field of Classification Search
CPC ..... H01Q 3/06; H01Q 1/20; H01Q 15/246; H01P 1/16; H01P 1/161; H01P 5/04; H01P 1/165
USPC ..... 333/21 A, 254, 256, 257, 259, 261
See application file for complete search history.

(56) References Cited

U.S. PATENT DOCUMENTS 4,353,041 A * 10/1982 Bryans ..... H01P 1/172 333/21 A
2008/0068274 A1 3/2008 Watanabe et al.

FOREIGN PATENT DOCUMENTS

EP 1 903 630 A1 3/2008
JP S52-147047 A 12/1977
(Continued)

OTHER PUBLICATIONS

International Search Report corresponding to PCT/JP2015/057518, dated May 26, 2015 (5 pages).

*Primary Examiner* — Rakesh Patel
*Assistant Examiner* — Jorge Salazar, Jr.
(74) *Attorney, Agent, or Firm* — Wilmer Cutler Pickering Hale and Dorr LLP

(57) ABSTRACT

A radio system includes: a radio device; an antenna device; and a polarization converting circuit for changing the directions of polarized waves, inserted at a position between the radio device and the antenna device. The polarization converting circuit is installed inside a holder in a device interface portion, and the device interface portion has a through hole that penetrates from the outer wall of the device interface portion to the outer periphery of the polarization converting circuit and is used to confirm the rotating angle of the polarization converting circuit inside the holder.

9 Claims, 7 Drawing Sheets

(56) References Cited

FOREIGN PATENT DOCUMENTS

| | | | |
|---|---|---|---|
| JP | S62-058901 | U | 4/1987 |
| JP | S63-099407 | U | 6/1988 |
| JP | S64-005501 | U | 1/1989 |
| JP | H03-243002 | A | 10/1991 |
| JP | H05-075576 | U | 10/1993 |
| JP | H06-029722 | A | 2/1994 |
| JP | 2003-179510 | A | 6/2003 |
| JP | 2004-076857 | A | 3/2004 |
| JP | 2004-297532 | A | 10/2004 |
| JP | 2004-320583 | A | 11/2004 |
| JP | 2004-363764 | A | 12/2004 |
| JP | 2008-078743 | A | 4/2008 |
| JP | 4835850 | B2 | 12/2011 |

* cited by examiner

RADIO SYSTEM

CROSS-REFERENCE TO RELATED APPLICATIONS

This application is a national stage application of International Application No. PCT/JP2015/057518 entitled "RADIO SYSTEM," filed on Mar. 13, 2015, which claims priority to Japanese Patent Application No 2014-089939, filed on Apr. 24, 2014, the disclosures of each which are hereby incorporated by reference in their entirety.

TECHNICAL FIELD

The present invention relates to a radio system including a polarization converting circuit between a radio device and an antenna device.

BACKGROUND ART

For example, in a radio system installed outdoors and used for point-to-point communication networks, waveguides are used to establish connection between the radio device (transmitter and receiver) and the antenna device to transmit RF (Radio Frequency) signals such as microwaves, milliwaves and others. Most radio systems of this kind use linearly polarized waves, in different manners, including horizontally polarized waves, vertically polarized waves and 45-degree polarized waves as RF signals to be transmitted via the antenna device. Accordingly, there occur cases where the polarized wave of the RF signal that propagates through the antenna element and waveguide of the antenna device and the polarized wave of the RF signal that propagates in the waveguide of the radio device have different directions (horizontal, vertical and 45 degrees).

In order to make the directions of the polarized waves of the RF signals transmitted inside the radio device and the antenna device coincide, a well-known polarization converting circuit can be inserted between the radio device and the antenna device to change the directions of the polarizations. A configurational example of the polarization converting circuit is given in Patent Document 1, for example.

FIG. 1A is a side sectional diagram showing a configuration of a radio system related to the present invention. FIG. 1B is a schematic diagram showing sectional shapes of the radio system cut along a plane A-A', plane B-B' and plane C-C' shown in FIG. 1A.

The related art radio system includes a radio device and an antenna device, each having a waveguide (not shown) and is configured so that the radio device and antenna device are connected and fixed to each other with the open ends of their waveguides abutted against each other. In the following description, the abutment of the radio device with the antenna device is called 'device interface portion' and the abutment of the antenna device with the radio device is called 'antenna interface portion'. The waveguides provided for the radio device and the antenna device are fixed to the device interface portion and the antenna interface portion with their open ends exposed. FIG. 1A gives a configurational example of these device interface portion 101 and antenna interface portion 102 and their connection example.

As shown in FIG. 1A, polarization converting circuit 103 is set inside holder 104 arranged on the opening end side of the device interface portion 101 so as to be positioned between the waveguide of the radio device and the waveguide of the antenna device. The abutment faces of device interface portion 101 and antenna interface portion 102 are sealed with annular gasket 105 or the like so as to secure airtightness of the radio device and the antenna device installed outdoors.

FIG. 1B show examples of the shapes of the waveguides and polarization converting circuit 103, viewed from the opening end side, in device interface portion 101 and antenna interface portion 102. The rectangular hole inside each circle that represents the contour of the waveguide or polarization converting circuit 103 in FIG. 1B forms the transmission path of RF signals. In FIG. 1A, the hole that penetrates through device interface portion 101, antenna interface portion 102 and polarization converting circuit 103 forms a transmission path. "Device" shown in FIG. 1B represents device interface portion 101, "Conversion" represents polarization converting circuit 103 and "Antenna" represents antenna interface portion 102.

The radio system shown in FIGS. 1A and 1B shows an example in which the RF signal propagates as 45-degree polarized ($\theta$=45 deg.) in the radio device and the RF signal propagates as vertically polarized ($\theta$=0 deg.) or as horizontally polarized ($\theta$=90 deg.). In this case, polarization converting circuit 103 is set at such an angle as to rotate the direction of the polarized waves without causing any reflection of the RF signal at the input and output ends. For example, when the RF signal propagates in vertical polarization in the antenna device, the rotating angle $\theta$ is set at +22.5 deg., whereas when the RF signal propagates in horizontal polarization, the rotating angle $\theta$ is set at +67.5 deg.

As shown in FIG. 1A, in the related art radio system, in order to secure airtightness of the radio device and the antenna device installed outdoors the polarization converting circuit is often built in the radio device. Therefore, the radio device and the antenna device are usually constructed such that the polarization converting circuit cannot be viewed from the outside.

Accordingly, the related art radio system entails the problem that the rotating angle of the polarization converting circuit cannot be confirmed at the time of, for example, installing the radio system after the radio device and the antenna device have been connected.

When the directions of the polarization of the RF signal differ between the radio device and the antenna device, there are some cases where the polarization converting circuit has been previously fixed at a predetermined rotating angle to the device interface portion, based on the relationship of polarizations between the radio device and the antenna device. In such a case, to avoid making any connection mistakes when connecting the radio device and the antenna device, it is necessary to carry out a task such as dismounting the antenna device in order to confirm the rotating angle of the polarization converting circuit, for example.

RELATED ART DOCUMENTS

Patent Document

Patent Document 1: Japanese Patent No. 4835850

SUMMARY

It is therefore an object of the present invention to provide a radio system in which the rotating angle of the polarization converting circuit can be confirmed from the outside.

A radio system of the present invention for achieving the above object includes a radio device, an antenna device, and a polarization converting circuit for changing the directions of polarized waves, inserted between the radio device and the antenna device in order to make the directions of polarization of RF (Radio frequency) signals transmitted inside the radio device and the antenna device coincide, wherein the polarization converting circuit is installed in a holder provided inside a device interface portion in the radio device, or in the abutment against the antenna device, and the device interface portion has a through hole that is used to confirm the rotating angle of the polarization converting circuit inside the holder and is formed to penetrate from the outer wall of the device interface portion to the outer periphery of the polarization converting circuit.

A radio system includes:

a radio device, an antenna device, and a polarization converting circuit for changing the directions of polarized waves, inserted between the radio device and the antenna device in order to make the directions of polarization of RF (Radio frequency) signals transmitted inside the radio device and the antenna device coincide, wherein the polarization converting circuit is installed in a holder provided inside a device interface portion in the radio device, or in the abutment against the antenna device, and the holder has a cutout portion that exposes part of the outer periphery of the polarization converting circuit to the outside, and, a projected part or an indented part that can be viewed through the cutout portion from the outside is formed on the outer periphery of the polarization converting circuit.

A radio system includes:

a radio device, an antenna device, and a polarization converting circuit for changing the directions of polarized waves, inserted between the radio device and the antenna device in order to make the directions of polarization of RF (Radio frequency) signals transmitted inside the radio device and the antenna device coincide, wherein the abutment face of the polarization converting circuit against the radio device has the same configuration as that of the antenna interface portion or the abutment against the radio device while the abutment face of the polarization converting circuit against the antenna device has the same configuration as that of the device interface portion or the abutment against the antenna device, and, the polarization converting circuit has a label or an impressed seal for identifying the rotating angle of the polarization converting circuit, formed on the outer periphery thereof.

EXEMPLARY EMBODIMENT

Next, the present invention will be described with reference to the drawings.

(The First Exemplary Embodiment)

Figure 1A:
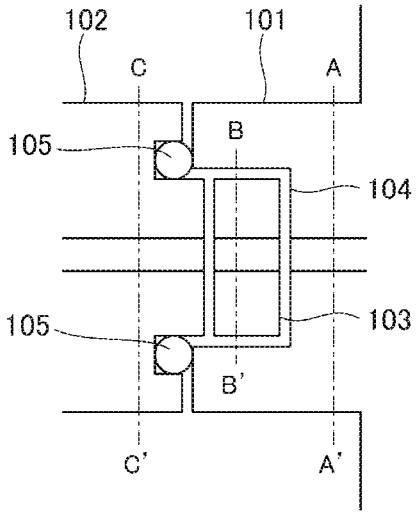
PRIOR ART FIG. 1A
FIG. 1A is a sectional side view showing a configuration of a radio system related to the present invention.
Figure 1B:
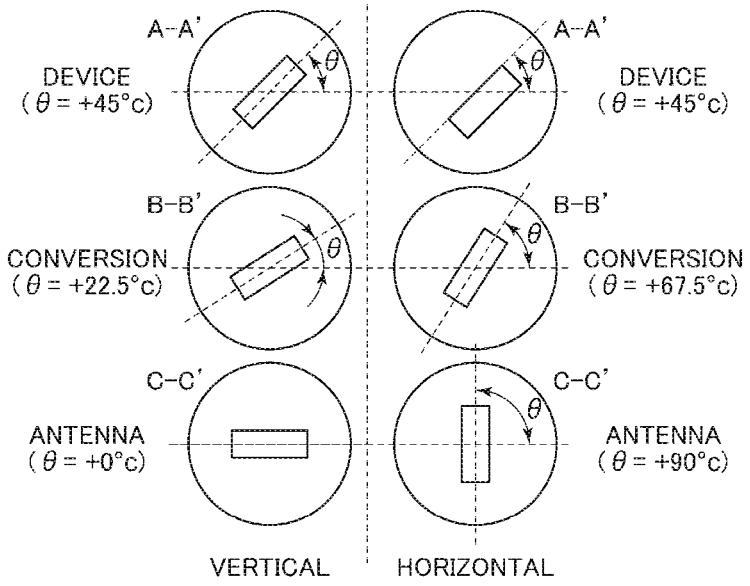
PRIOR ART FIG. 1B
FIG. 1B is a schematic diagram showing sectional shapes of the radio system shown in FIG. 1A, cut along line A-A', line B-B' and line C-C'.
Figure 2A:
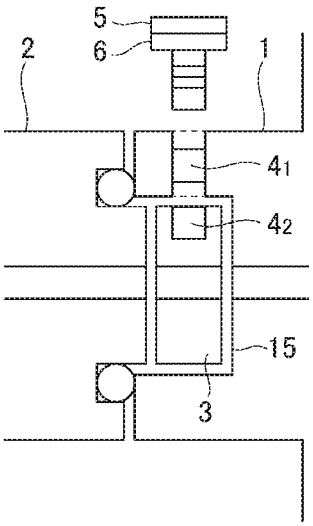
FIG. 2A is a sectional side view showing a configurational example of a radio system according to the first exemplary embodiment.
Figure 2B:
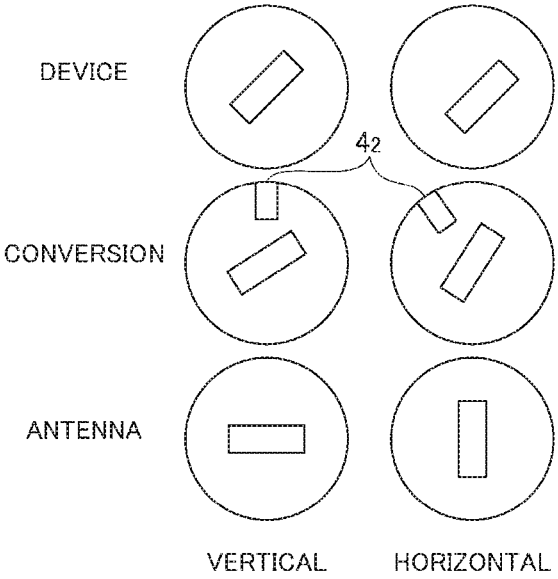
FIG. 2B is a schematic diagram showing one example of sectional shapes of the radio system shown in FIG. 2A.

FIG. 2A is a sectional side view showing a configurational example of a radio system according to the first exemplary embodiment, and FIG. 2B is a schematic diagram showing one example of sectional shapes of the radio system shown in FIG. 2A. Here, FIG. 2B shows, similarly to FIG. 1B, one example of the sectional shapes of antenna interface portion 2, polarization converting circuit 3 and device interface portion 1, viewed from the same directions, cut along line A-A', line B-B' and line C-C' in FIG. 1A. Also, "Device" shown in FIG. 2B represents device interface portion 1, "Conversion" represents polarization converting circuit 3 and "Antenna" represents antenna interface portion 2.

As shown in FIGS. 2A and 2B, the radio system in the first exemplary embodiment is configured, similarly to the related art radio system shown in FIG. 1A, such that polarization converting circuit 3 is arranged in holder 15 provided inside device interface portion 1.

Device interface portion 1 is formed with a through hole $\mathbf{4}_1$ reaching the outer periphery of the polarization converting circuit 3 from the outer wall of the device interface portion 1 so as to allow for confirmation of the rotating angle of the polarization converting circuit 3 inside holder 15. Polarization converting circuit 3 also has a hole $\mathbf{4}_2$ formed on the outer periphery thereof.

Screw 5 is fitted into through hole $\mathbf{4}_1$ of device interface portion 1 in a normal condition in order to secure airtightness of the radio device, and removed when the rotating angle of the polarization converting circuit 3 is examined. Screw 5 is provided with packing 6 at the position abutting device interface portion 1 in order to secure airtightness inside the radio device.

Hole $\mathbf{4}_2$ formed on the outer periphery of polarization converting circuit 3 has an indented shape that does not reach the transmission path of the RF signal, is formed at a position to communicate with hole $\mathbf{4}_1$ when polarization converting circuit 3 is set at the predetermined rotating angle, and has an opening diameter that allows communication with through hole $\mathbf{4}_1$. Hole $\mathbf{4}_2$ may and should be sized so that its opening diameter is greater than through hole $\mathbf{4}_1$ and so as not to communicate with through hole $\mathbf{4}_1$ when the rotating angle of polarization converting circuit 3 is changed. The other configuration is the same as the related art radio system shown in FIGS. 1A and 1B, so that detailed description is omitted.

In this configuration, it is possible to determine the rotating angle of polarization converting circuit 3 by removing screw 5, inserting, for example a pin (not shown) of a predetermined length from through hole $\mathbf{4}_1$ of device interface portion 1 to check whether the hole $\mathbf{4}_2$ on the outer periphery of the polarization converting circuit 3 is aligned, from the inserted length of the pin. A wire or the like that has such a length can be used as the pin to confirm the inserted length. Anything can be used as the pin as long as it can check the inserted length when inserted into through hole $\mathbf{4}_1$ of device interface portion 1.

FIGS. 2A and 2B show an example in which through hole $\mathbf{4}_1$ of device interface portion 1 communicates with hole $\mathbf{4}_2$ on the outer periphery of polarization converting circuit 3, hence the inserted length of the pin becomes long when polarization converting circuit 3 is set at the rotating angle for converting the RF signal from 45-degree polarization into vertical polarization.

According to the present embodiment, through hole $\mathbf{4}_1$ is formed in device interface portion 1 while hole $\mathbf{4}_2$ is formed on the outer periphery of polarization converting circuit 3, whereby it is possible to determine the rotating angle of polarization converting circuit 3 from the inserted length of the pin inserted into through hole $\mathbf{4}_1$ of device interface portion 1. Accordingly, it is possible to confirm the rotating angle of polarization converting circuit 3 from the outside even when the antenna device remains connected to the radio device.

As a result, it is not necessary to perform tasks such as removing the antenna device once again in order to confirm the rotating angle of the polarization converting circuit after a connection has been made between the radio device and the antenna device. Further, it is possible to prevent making a wrong connection between the radio device and the antenna device by checking the rotating angle of polarization converting circuit 3 from the outside.

(The Second Exemplary Embodiment)

Figure 3A:
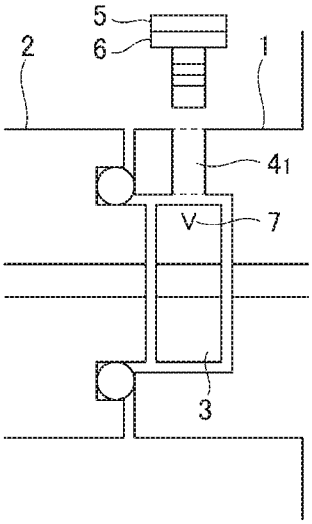
FIG. 3A is a sectional side view showing a configurational example of a radio system according to the second exemplary embodiment.
Figure 3B:
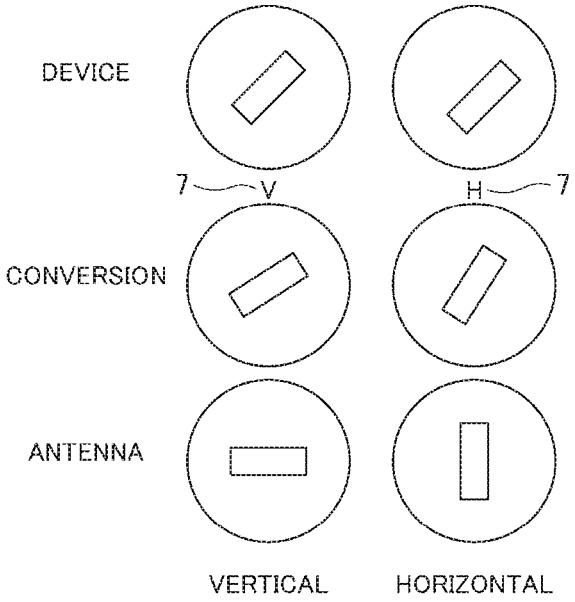
FIG. 3B is a schematic diagram showing one example of sectional shapes of the radio system shown in FIG. 3A.

FIG. 3A is a sectional side view showing a configurational example of a radio system according to the second exemplary embodiment, and FIG. 3B is a schematic diagram showing one example of sectional shapes of the radio system shown in FIG. 3A. Here, FIG. 3B shows, similarly to FIG. 2B, one example of the sectional shapes of antenna interface portion 2, polarization converting circuit 3 and device interface portion 1, viewed from the same directions, cut along line A-A', line B-B' and line C-C' in FIG. 1A. Also, "Device" shown in FIG. 3B represents device interface portion 1, "Conversion" represents polarization converting circuit 3 and "Antenna" represents antenna interface portion 2.

As shown in FIGS. 3A and 3B, instead of hole $\mathbf{4}_2$ shown in the first exemplary embodiment, the radio system of the second exemplary embodiment is formed with label (or impressed seal) 7 representing the rotating angle of polarization converting circuit 3, on the outer periphery of polarization converting circuit 3. Label (or impressed seal) 7 may and should be formed on the outer periphery at a position corresponding to the position of through hole $\mathbf{4}_1$ of device interface portion 1 when polarization converting circuit 3 is set at the predetermined rotating angle. Label (or impressed seal) 7 may display the directions of the polarized waves after conversion as long as the rotating angle of polarization converting circuit 3 can be identified. Since the other configuration is the same as the radio system of the first exemplary embodiment shown in FIGS. 2A and 2B, detailed description is omitted.

FIG. 3B shows an example in which label (V) 7 is attached to the outer periphery of polarization converting circuit 3 at a position corresponding to the position of through hole $\mathbf{4}_1$ when polarization converting circuit 3 is set at the rotating angle for converting the RF signal from 45-degree polarization to vertical polarization. FIG. 3B also shows an example in which label (H) 7 is attached on the outer periphery of polarization converting circuit 3 at a position corresponding to the position of through hole $\mathbf{4}_1$ when polarization converting circuit 3 is set at the rotating angle for converting the RF signal from 45-degree polarization to horizontal polarization.

In this configuration, it is possible to determine the rotating angle of polarization converting circuit 3 by removing screw 5 and visually observing label (impressed seal) 7 on polarization converting circuit 3 from through hole $\mathbf{4}_1$ of device interface portion 1.

Accordingly, also in the radio system of the second exemplary embodiment, it is possible to confirm the rotating angle of polarization converting circuit 3 from the outside of the radio device, and hence to obtain the same effect as in the first exemplary embodiment.

(The Third Exemplary Embodiment)

Figure 4A:
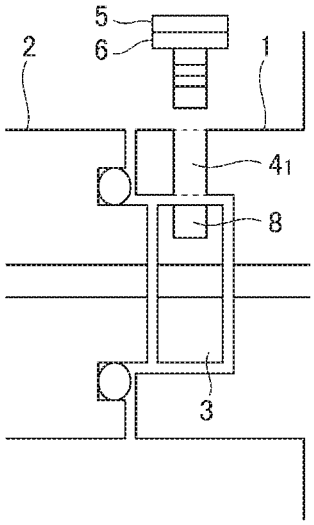
FIG. 4A is a sectional side view showing a configurational example of a radio system according to the third exemplary embodiment.
Figure 4B:
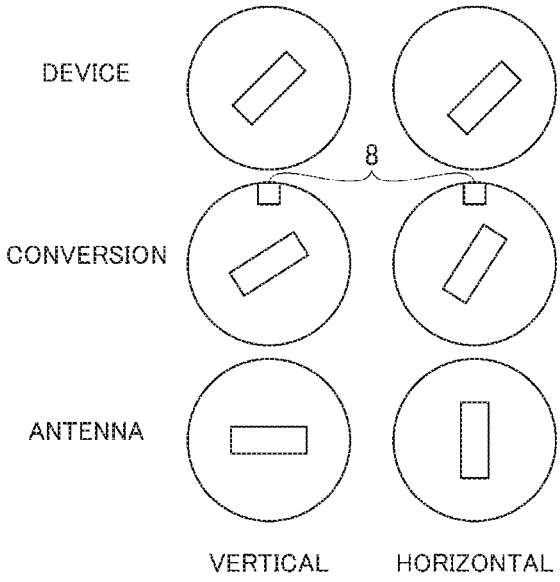
FIG. 4B is a schematic diagram showing one example of sectional shapes of the radio system shown in FIG. 4A.

FIG. 4A is a sectional side view showing a configurational example of a radio system according to the third exemplary embodiment, and FIG. 4B is a schematic diagram showing one example of sectional shapes of the radio system shown in FIG. 4A. Here, FIG. 4B shows, similarly to FIG. 3B, one example of the sectional shapes of antenna interface portion 2, polarization converting circuit 3 and device interface portion 1, viewed from the same directions, cut along line A-A', line B-B' and line C-C' in FIG. 1A. Also, "Device" shown in FIG. 4B represents device interface portion 1, "Conversion" represents polarization converting circuit 3 and "Antenna" represents antenna interface portion 2.

As shown in FIGS. 4A and 4B, instead of label (or impressed seal) 7 shown in the second exemplary embodiment, the radio system of the third exemplary embodiment has painted part 8 with arbitrary colors applied on the outer periphery of polarization converting circuit 3. Painted part 8 may and should be formed on the outer periphery at a position corresponding to the position of through hole $\mathbf{4}_1$ of device interface portion 1 when polarization converting circuit 3 is set at the predetermined rotating angle. Painted part 8 may be given different colors depending on the rotating angle so as to allow identification of the rotating angle of polarization converting circuit 3. Since the other configuration is the same as the radio system of the second exemplary embodiment shown in FIG. 3, detailed description is omitted.

Also in this configuration, it is possible to determine the rotating angle of polarization converting circuit 3 by removing screw 5 and visually observing painted part 8 on polarization converting circuit 3 from through hole $\mathbf{4}_1$ of device interface portion 1, similarly to the second exemplary embodiment.

Accordingly, also in the radio system of the third exemplary embodiment it is possible to confirm the rotating angle of polarization converting circuit 3 from the outside of the radio device, and hence to obtain the same effect as in the first exemplary embodiment.

(The Fourth Exemplary Embodiment)

Figure 5:
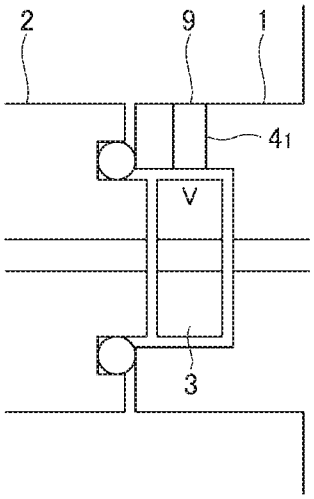
FIG. 5 is a sectional side view showing a configurational example of a radio system according to the fourth exemplary embodiment.

FIG. 5 is a sectional side view showing a configurational example of a radio system according to the fourth exemplary embodiment.

As shown in FIG. 5, the radio system of the fourth exemplary embodiment is realized in the configuration of the second exemplary embodiment or the third exemplary embodiment, in which through hole $\mathbf{4}_1$ of device interface portion 1 is closed by cover 9, as substitute for screw 5 shown in the first exemplary embodiment. Cover 9 may be formed of plastic, acrylic or other resin, and is more preferable if it is transparent. Since the other configuration is the same as the radio system of the second exemplary embodiment shown in FIG. 3 or the radio system of the third exemplary embodiment shown in FIGS. 4A and 4B, detailed description is omitted.

Similarly to the second and third exemplary embodiments, also in this configuration it is possible to determine the rotating angle of polarization converting circuit 3 by visually observing the label (or impressed seal) 7 or the color of painted part 8 on polarization converting circuit 3, by removing cover 9 or through transparent cover 9.

Accordingly, also in the radio system of the fourth exemplary embodiment it is possible to confirm the rotating angle of polarization converting circuit 3 from the outside of the radio device, and hence to obtain the same effect as in the first exemplary embodiment.

(The Fifth Exemplary Embodiment)

Figure 6A:
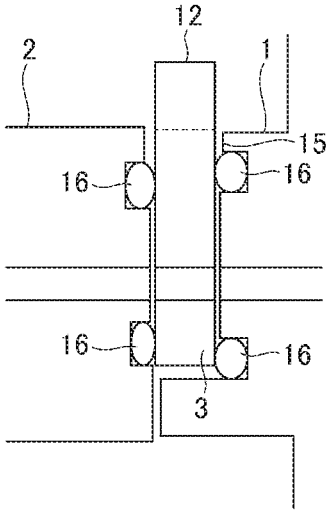
FIG. 6A is a sectional side view showing a configurational example of a radio system according to the fifth exemplary embodiment.
Figure 6B:
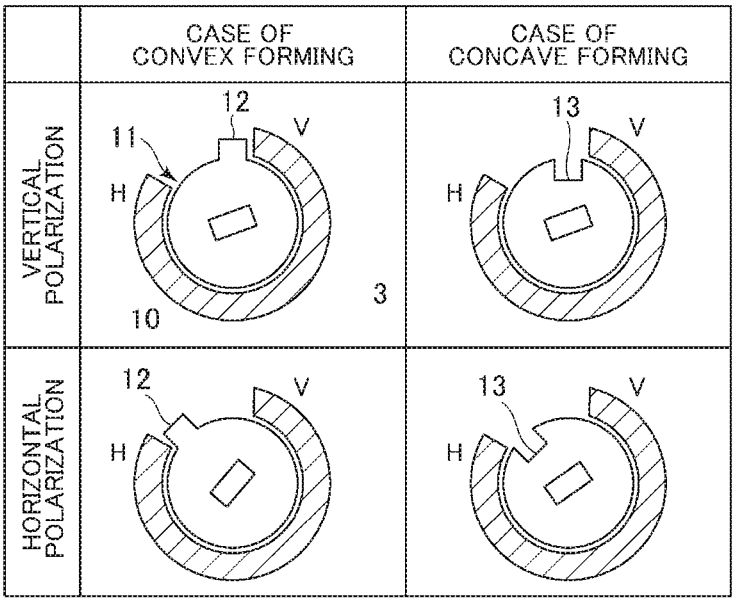
FIG. 6B is a schematic diagram showing one example of rotating angles of a polarization converting circuit, viewed from the antenna device side.

FIG. 6A is a sectional side view showing a configurational example of a radio system according to the fifth exemplary embodiment. FIG. 6B is a schematic diagram showing one example of rotating angles of a polarization converting circuit, viewed from the antenna device side. Here, "vertical polarization" shown in FIG. 6B represents how polarization converting circuit 3 is set at the rotating angle for converting 45-degree polarization to vertical polarization. On the other hand, "horizontal polarization" shown in FIG. 6B represents how polarization converting circuit 3 is set at the rotating angle for converting 45-degree polarization to horizontal polarization.

As shown in FIGS. 6A and 6B, the radio system of the fifth exemplary embodiment is configured so that holder 15 of device interface portion 1 has a cutout portion 11 to expose part of the outer periphery of polarization converting circuit 3 to the outside. Projected part 12 or indented part 13 is formed on the outer periphery of polarization converting circuit 3. Projected part 12 or indented part 13 of polarization converting circuit 3 is formed at such a position so that projected part 12 or indented part 13 can be seen through cutout portion 11 from the outside. FIG. 6A shows a configurational example in which projected part 12 is formed on the outer periphery of polarization converting circuit 3.

The abutment surfaces against device interface portion 1 and antenna interface portion 2 are sealed using annular gaskets 16 or the like arranged deviated from cutout portion 11 in order to secure airtightness of the radio device and the antenna device installed outdoors. The other configuration is the same as that of the related art radio system shown in FIG. 1, so that detailed description is omitted.

In this configuration, it is possible to confirm the rotating angle of polarization converting circuit 3 from the position of projected part 12 or indented part 13 formed on the outer periphery of polarization converting circuit 3. Herein, labels, impressed seals or the like may be added at both ends of cutout portion 11 so as to allow the user to identify the rotating angle of polarization converting circuit 3 and/or the directions of the polarized waves after conversion.

Accordingly, also in the radio systems of the fifth exemplary embodiment it is possible to confirm the rotating angle of polarization converting circuit 3 from the outside of the radio device, and hence to obtain the same effect as in the first exemplary embodiment.

Further, in the radio system of the fifth exemplary embodiment, when holder 15 is adapted to hold polarization converting circuit 3 in a rotatable manner, it is possible to rotate polarization converting circuit 3 even while the antenna device remains connected to the radio device. Accordingly, the directions of polarization of the RF signals can be easily changed from the outside by means of polarization converting circuit 3.

(The Sixth Exemplary Embodiment)

Figure 7:
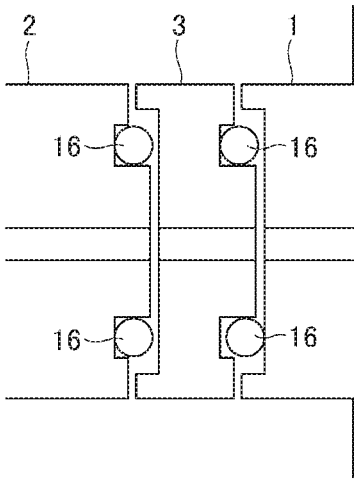
FIG. 7 is a sectional side view showing a configurational example of a radio system according to the sixth exemplary embodiment.

FIG. 7 is a sectional side view showing a configurational example of a radio system according to the sixth exemplary embodiment.

As shown in FIG. 7, the radio system of the sixth exemplary embodiment is configured so that polarization converting circuit 3 is fixed between device interface portion 1 and antenna interface portion 2.

In this exemplary embodiment, the abutment face of polarization converting circuit 3 against the radio device has the same configuration as that of antenna interface portion 2 while the abutment face of polarization converting circuit 3 against the antenna device has the same configuration as that of device interface portion 1. Use of this configuration makes it possible to insert polarization converting circuit 3 between the radio device and the antenna device without modifying the existing device interface portion 1 and antenna interface portion 2.

Further, by providing, for example, annular gasket 16 to serve as a seal at the abutment of polarization converting circuit 3 against, device interface portion 1, and antenna interface portion 2, airtightness of the radio device and the antenna device can be assured.

Moreover, on the outer periphery of polarization converting circuit 3, label (impressed seal) 7, that indicates the direction of polarization, may be provided similarly to the second exemplary embodiment, or painted part 8 with different colors painted depending on the direction of polarization may be provided similarly to the third exemplary embodiment. The other configuration is the same as that of the related art radio system shown in FIG. 1, so that detailed description is omitted.

Also in this configuration, it is possible to confirm the rotating angle of polarization converting circuit 3 by checking whether label (V or H) 7 on polarization converting circuit 3 is set at the predetermined position. Or, it is possible to confirm the rotating angle of polarization converting circuit 3 by the color of painted part 8 at the predetermined position.

Accordingly, also in the radio systems of the sixth exemplary embodiment, it is possible to confirm the rotating angle of polarization converting circuit 3 from the outside of the radio device, and hence to obtain the same effect as in the first exemplary embodiment.

Although the present invention has been explained with reference to the exemplary embodiments, the present invention should not be limited to the above exemplary embodiments. Various modifications that can be understood by those skilled in the art may be made to the structures and details of the present invention within the scope of the present invention.

This application claims priority based on Japanese Patent Application 2014-89939 filed on Apr. 24, 2014, and should incorporate all the disclosure thereof herein.

The invention claimed is:

1. A radio system comprising:

a radio device;

an antenna device; and a polarization converting circuit for changing the directions of polarized waves, inserted between the radio device and the antenna device in order to make the directions of polarization of RF (Radio frequency)

signals transmitted inside the radio device and the antenna device coincide, wherein the polarization converting circuit is installed in a holder provided inside a device interface portion which is an abutment against the antenna device in the radio device, and the device interface portion has a through hole that is used to confirm a rotating angle of the polarization converting circuit inside the holder and is formed to penetrate from an outer wall of the device interface portion to an outer periphery of the polarization converting circuit.

2. The radio system according to claim 1, wherein the polarization converting circuit has a hole that has an opening diameter and that allows communication with the through hole and that is formed on the outer periphery at a position that creates communication with the through hole when the polarization converting circuit is set at a predetermined angle.

3. The radio system according to claim 1, wherein the polarization converting circuit has a label or an impressed seal for identifying the rotating angle of the polarization converting circuit, formed at a position on the outer periphery corresponding to a position of the through hole when the polarization converting circuit is set at a predetermined angle.

4. The radio system according to claim 1, wherein the polarization converting circuit has a painted part with a color painted for identifying the rotating angle of the polarization converting circuit, and the painted part is formed at a position on the outer periphery corresponding to a position of the through hole when the polarization converting circuit is set at a predetermined angle.

5. The radio system according to claim 1, further comprising a screw that clogs the through hole.

6. The radio system according to claim 1, further comprising a cover that closes the through hole.

7. A radio system comprising:

a radio device;

an antenna device; and a polarization converting circuit for changing the directions of polarized waves, inserted between the radio device and the antenna device in order to make the directions of polarization of RF (Radio frequency) signals transmitted inside the radio device and the antenna device coincide, wherein the polarization converting circuit is installed in a holder provided inside a device interface portion which abuts against the antenna device in the radio device, and the holder has a cutout portion that exposes part of an outer periphery of the polarization converting circuit to the outside of the radio system, and, a projected part or an indented part that can be viewed through the cutout portion from the outside is formed on the outer periphery of the polarization converting circuit.

8. The radio system according to claim 7, wherein the device interface portion holds the polarization converting circuit in a rotatable manner by means of the holder.

9. A radio system comprising:

a radio device;

an antenna device; and a polarization converting circuit for changing the directions of polarized waves, fixed between the radio device and the antenna device in order to make the directions of polarization of RF (Radio frequency) signals transmitted inside the radio device and the antenna device coincide, wherein a first face of the polarization converting circuit that abuts against the radio device has the same shape as that of an antenna interface portion which abuts against the antenna device while a second face of the polarization converting circuit that abuts against the antenna device has the same shape as that of a radio device interface portion which is an abutment against the antenna device, and, the polarization converting circuit has a label or an impressed seal for identifying a rotating angle of the polarization converting circuit, formed on the outer periphery thereof.

* * * * *